US009863022B2

(12) United States Patent
Ichikawa et al.

(10) Patent No.: US 9,863,022 B2
(45) Date of Patent: *Jan. 9, 2018

(54) HIGH-STRENGTH ULTRA-THICK H-BEAM STEEL

(71) Applicant: Nippon Steel & Sumitomo Metal Corporation, Tokyo (JP)

(72) Inventors: Kazutoshi Ichikawa, Tokyo (JP); Masaki Mizoguchi, Tokyo (JP); Kazuaki Mitsuyasu, Tokyo (JP); Hirokazu Sugiyama, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/357,604

(22) PCT Filed: Dec. 11, 2012

(86) PCT No.: PCT/JP2012/082043

§ 371 (c)(1),
(2) Date: May 12, 2014

(87) PCT Pub. No.: WO2013/089089

PCT Pub. Date: Jun. 20, 2013

(65) Prior Publication Data

US 2014/0301889 A1 Oct. 9, 2014

(30) Foreign Application Priority Data

Dec. 15, 2011 (JP) ..... 2011-274279

(51) Int. Cl.

| | |
|---|---|
| ***C22C 38/04*** | (2006.01) |
| ***C22C 38/54*** | (2006.01) |
| ***C21D 8/00*** | (2006.01) |
| ***C22C 38/58*** | (2006.01) |
| ***C22C 38/00*** | (2006.01) |
| ***C22C 38/02*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C21D 8/02*** | (2006.01) |
| ***C22C 38/42*** | (2006.01) |
| ***C22C 38/44*** | (2006.01) |
| ***C22C 38/46*** | (2006.01) |
| ***C22C 38/50*** | (2006.01) |

(52) U.S. Cl.

CPC ..... *C22C 38/54* (2013.01); *C21D 8/00* (2013.01); *C21D 8/0226* (2013.01); *C21D 8/0263* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/42* (2013.01); *C22C 38/44* (2013.01); *C22C 38/46* (2013.01); *C22C 38/50* (2013.01); *C22C 38/58* (2013.01); *C21D 2211/002* (2013.01); *C21D 2211/004* (2013.01); *C21D 2211/008* (2013.01)

(58) Field of Classification Search

CPC ... C21D 8/00; C21D 8/04; C21D 8/12; C21D 8/14

See application file for complete search history.

(56) References Cited

U.S. PATENT DOCUMENTS

| | | | | |
|---|---|---|---|---|
| 4,990,196 | A * | 2/1991 | Tamehiro et al. | 148/652 |
| 6,258,181 | B1 * | 7/2001 | Yamamoto | C22C 38/001 148/332 |
| 9,057,122 | B2 | 6/2015 | Takaoka et al. | |
| 2005/0167013 | A1 | 8/2005 | Murao et al. | |
| 2010/0330387 | A1 | 12/2010 | Yoshida et al. | |

FOREIGN PATENT DOCUMENTS

| | | |
|---|---|---|
| CN | 101397627 | 4/2009 |
| CN | 101407893 | 4/2009 |
| CN | 101541994 | 9/2009 |
| EP | 0761824 | 3/1997 |
| EP | 0940477 | 9/1999 |

(Continued)

OTHER PUBLICATIONS

English Machine Translation of JP 2011106006 A, H. Nakamura, Jun. 2, 2011.*

International Search Report dated Feb. 12, 2013 issued in corresponding PCT Application No. PCT/JP2012/082043 [with English Translation].

(Continued)

*Primary Examiner* — Roy King
*Assistant Examiner* — Jophy S Koshy
(74) *Attorney, Agent, or Firm* — Birch, Stewart, Kolasch & Birch, LLP

(57) ABSTRACT

This H-beam steel has a composition including C, Si, Mn, Cu, Ni, V, Al, Ti, B, N, and O, and further including at least one of Mo and Nb, in which Ceq obtained in Equation 1 described below falls in a range of 0.37 to 0.50, the thickness of a flange falls in a range of 100 to 150 mm, and the area fraction of bainite at a depth of one quarter of the thickness of the flange from the external surface of the flange is 60% or more.

$$Ceq=C+Mn/6+(Mo+V)/5+(Ni+Cu)/15 \quad \text{Equation 1,}$$

where C, Mn, Mo, V, Ni, and Cu represent the amount of each element contained.

9 Claims, 1 Drawing Sheet

(56) References Cited

FOREIGN PATENT DOCUMENTS

| | | | | |
|---|---|---|---|---|
| JP | 04-279247 | | 10/1992 | |
| JP | 05-263182 | | 10/1993 | |
| JP | 07090474 | | 4/1995 | |
| JP | 09-194985 | | 7/1997 | |
| JP | 10-147835 | | 6/1998 | |
| JP | 11131188 | | 5/1999 | |
| JP | 2000-054060 | | 2/2000 | |
| JP | 2000-080440 | | 3/2000 | |
| JP | 2000328174 | | 11/2000 | |
| JP | 2001-003136 | | 1/2001 | |
| JP | 2001-11567 | A | 1/2001 | |
| JP | 2001254139 | | 9/2001 | |
| JP | 2002-3986 | A | 1/2002 | |
| JP | 2002003986 | | 1/2002 | |
| JP | 2002-256377 | A | 9/2002 | |
| JP | 2002256377 | | 9/2002 | |
| JP | 2002-309338 | A | 10/2002 | |
| JP | 2002309338 | | 10/2002 | |
| JP | 2003-160833 | | 6/2003 | |
| JP | 3507258 | B2 | 3/2004 | |
| JP | 3960341 | | 8/2007 | |
| JP | 2007-277629 | | 10/2007 | |
| JP | 2011-106006 | | 6/2011 | |
| JP | 2011106006 | A * | 6/2011 | ..... C22C 38/00 |
| JP | 2011157573 | | 8/2011 | |
| JP | 2011179106 | | 9/2011 | |
| JP | 2011202210 | | 10/2011 | |
| JP | 2011-246806 | | 12/2011 | |
| JP | 2012-180584 | A | 9/2012 | |
| WO | 0175182 | | 10/2001 | |
| WO | 2010013358 | | 2/2010 | |
| WO | WO2011/065479 | | 6/2011 | |

OTHER PUBLICATIONS

Search Report dated May 4, 2015 issued in corresponding European Application No. 12856806.0.

Office Action dated Aug. 4, 2015 issued in related Chinese Application No. 201280056107.7 [with English Translation of Search Report].

International Search Report dated Feb. 4, 2014 issued in related International Application No. PCT/JP2013/080660 [with English Translation].

Office Action dated Aug. 19, 2014 issued in related Japanese Application No. 2014-517284 [with English Translation] .

Office Action dated Oct. 23, 2015 issued in related U.S. Appl. No. 14/416,403.

Office Action dated Jan. 14, 2016 issued in related Chinese Application No. 201380039137.1 [with English Translation].

Search Report dated Mar. 18, 2016 issued in related European Application No. 13856612.0.

International Search Report dated May 20, 2014 issued in related International Application No. PCT/JP2014/056135 [with English Translation].

Extended European Search Report for European Application No. 14764532.9, dated Oct. 17, 2016.

* cited by examiner

HIGH-STRENGTH ULTRA-THICK H-BEAM STEEL

TECHNICAL FIELD

The present invention relates to a high-strength ultra-thick H-beam steel used, for example, as a structural element of buildings and exhibiting excellent toughness.

This application is a national stage application of International Application No. PCT/JP2012/082043, filed Dec. 11, 2012, which claims priority to Japanese Patent Application No. 2011-274279 filed in Japan on Dec. 15, 2011, each of which is incorporated by reference in its entirety.

BACKGROUND ART

For building structures, in particular, high-rise buildings, it is required that H-beam steels with a thickness of 100 mm or more (hereinafter, referred to as ultra-thick H-beam steels) are used. These ultra-thick H-beam steels are required to have high performance such as improved toughness as well as increased strength, for example, in accordance with strict safety standards. Conventionally, a rolled formed steel having large amounts of Cu, Nb. V, and Mo added thereto in order to suppress formation of island martensite is proposed (see, for example, Patent Document 1).

Further, these H-beam steels have specific shapes, and hence, rolling conditions (temperatures and rolling reductions) are limited in universal rolling. Thus, rolling finishing temperatures, rolling reduction, and the rate of cooling are more likely to vary depending on the portions of ultra-thick H-beam steel used, especially in the case of a web, flanges, and fillets. As a result, strength, ductility, and toughness vary depending on portions in the ultra-thick H-beam steel, and some portions of the steel may not satisfy requirements, for example, for the rolled steels for welded structure (JIS G 3106).

In particular, if ultra-thick H-beam steels are manufactured by applying hot rolling to blooms obtained through continuous casting, it is difficult to secure toughness through reduction in the size of crystal grain. This is because the maximum thickness of the bloom that continuous-casting equipment can manufacture is limited, and hence, it is not possible to obtain sufficient rolling reduction during rolling operations. Further, if rolling is performed at high temperatures to obtain products with high dimensional accuracy, the thick flange portion has high rolling temperature, which leads to a decrease in the rate of cooling. As a result, at the flange portion, crystal grains coarsen, and in particular, toughness is more likely to deteriorate.

To address these problems, there is proposed a method of reducing the size of crystal grains by diffusing Ti-based oxide in the steel to generate intragranular ferrite (see, for example, Patent Document 2). Further, there is proposed a method of manufacturing high-strength rolled formed steels exhibiting excellent toughness through temperature-controlled rolling and accelerated cooling in addition to reduction in the size and diffusion of Ti oxide and TiN (see, for example, Patent Documents 3 to 5). Further, a manufacturing method in which the amount of carbon contained is reduced to improve toughness is proposed (for example, Patent Document 6).

RELATED ART DOCUMENTS

Patent Document

Patent Document 1: Japanese Unexamined Patent Application, First Publication No. H9-194985

Patent Document 2: Japanese Unexamined Patent Application, First Publication No. H5-263182

Patent Document 3: Japanese Unexamined Patent Application, First Publication No. H10-147835

Patent Document 4: Japanese Unexamined Patent Application, First Publication No. 2000-54060

Patent Document 5: Japanese Unexamined Patent Application, First Publication No. 2001-3136

Patent Document 6: PCT International Publication No. WO 2011-065479

DISCLOSURE OF THE INVENTION

Problems to be Solved by the Invention

However, if ultra-thick H-beam steels having a flange thickness with 100 mm or more are manufactured, it is difficult to increase the rate of cooling even if accelerated cooling is performed after hot rolling, and hence, it is difficult to secure strength and toughness. Further, H-beam steels have specific shapes, and hence, hot rolling needs to be performed to the H-beam steels at temperatures higher than those applied to steel sheets, which makes it difficult to obtain a fine structure. The present invention has been made in view of the facts described above, and provides a high-strength ultra-thick H-beam steel exhibiting excellent strength and toughness.

Means for Solving the Problem

The following are the main points of the present invention.

(1) The first aspect of the present invention provides an H-beam steel with a composition including, in mass %: C: 0.09 to 0.15%; Si: 0.07 to 0.50%; Mn: 0.80 to 2.00%; Cu: 0.04 to 0.40%; Ni: 0.04 to 0.40%; V: 0.01 to 0.10%; Al: 0.005 to 0.040%; Ti: 0.001 to 0.025%; B: 0.0003 to 0.0012%; N: 0.001 to 0.0090%; and O: 0.0005 to 0.0035%, further including at least one of Mo: 0.02 to 0.35% and Nb: 0.01 to 0.08%; P: limited to 0.03% or less; and S: limited to 0.02% or less, with a balance including Fe and inevitable impurities, in which Ceq obtained with Equation 1 described below falls in a range of 0.37 to 0.50, the thickness of a flange falls in a range of 100 to 150 mm, and an area fraction of bainite at a depth of one quarter of the thickness of the flange from the external surface of the flange is 60% or more.

$$Ceq=C+Mn/6+(Mo+V)/5+(Ni+Cu)/15 \quad \text{Equation 1}$$

(2) In the H-beam steel according to (1) described above, the composition may further include, in mass %, Cr: 0.20% or less, and Ceq obtained with Equation 2 described below may fall in a range of 0.37 to 0.50.

$$Ceq=C+Mn/6+(Cr+Mo+V)/5+(Ni+Cu)/15 \quad \text{Equation 2}$$

(3) In the H-beam steel according to (1) or (2) described above, yield strength or 0.2% proof strength may be 450 MPa or more, and tensile strength may be 550 MPa or more.

Effects of the Invention

According to the present invention, it is possible to obtain a high-strength ultra-thick H-beam steel having a flange thickness in a range of 100 to 150 mm, yield strength or 0.2% proof strength of 450 MPa or more, and tensile strength of 550 MPa or more. The high-strength ultra-thick H-beam steel according to the present invention can be manufactured without adding a large amount of alloys or reducing carbon to the ultra low carbon level, which causes significant steel-making loads. This makes it possible to reduce manufacturing costs and shorten manufacturing time, thereby achieving a significant reduction in the total costs. Thus, reliability of large buildings can be enhanced without sacrificing cost efficiency, and hence, the present invention makes an extremely significant contribution to industries.

EMBODIMENTS OF THE INVENTION

Figure 1:
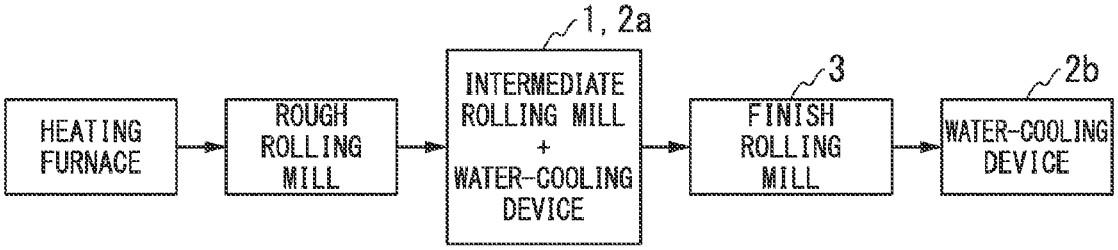
FIG. 1 is a diagram illustrating an example of a device of manufacturing an H-beam steel according to an embodiment of the present invention.

In order to enhance the strength and toughness, it is desirable to increase hardenability and suppress formation of ferrite, thereby securing bainite. The present inventors carried out a study of appropriate components that can enhance the strength and toughness at the same time, on the basis of a fact that the rate of cooling is not more than 15° C./s at a ¼ portion of a flange even if the ultra-thick H-beam steel having a flange thickness of 100 mm or more is subjected to hot rolling and then, accelerated cooling. As a result, the present inventors found that it is possible to significantly enhance the hardenability with the synergistic effect by at the same time adding to the steel a very small amount of B plus either a small amount of Mo or a small amount of Nb, or both a small amount of Mo and a small amount of Nb, and it is possible to secure the strength and toughness by performing accelerated cooling after hot rolling to suppress formation of ferrite.

Further, the present inventors also found that, by setting a carbon equivalent Ceq in an appropriate range, and making the steel contain either or both of the small amount of Mo and the small amount of Nb, and a very small amount of B at the same time, the hardenability can be further enhanced even if the amount of alloy contained is not large. Yet further, they also found that, if the ultra-thick H-beam steel is manufactured by subjecting steels having the components as described above to hot rolling and accelerated cooling such as water cooling, the formation of ferrite, which is formed through transformation from austenite grain boundary, is suppressed, and the area fraction of bainite is 60% or more, whereby the high strength improves without deteriorating the toughness.

Hereinbelow, the H-beam steel according to an embodiment of the present invention based on the findings described above will be described.

First, composition of the H-beam steel according to this embodiment will be described. Hereinafter, the symbol "%" indicating the amount of each component contained means "mass %" unless otherwise specified.

C: 0.09% to 0.15%

C is an element effective in strengthening steels, and the lower limit value of the amount of C contained is set to 0.09% or more. Preferably, the amount of C contained is set to 0.10% or more. On the other hand, if the amount of C contained exceeds 0.15%, carbides are formed, and toughness deteriorates. Thus, the upper limit of the amount of C contained is set to 0.15% or less. In order to further improve the toughness, it is preferable to set the upper limit of the amount of C contained to 0.14% or less.

Si: 0.07% to 0.50%

Si is a deoxidizing element, and contributes to improving strength. Thus, the lower limit of the amount of Si contained is set to 0.07% or more. In order to enhance the strength, the amount of Si contained is set preferably to 0.10% or more, more preferably 0.20 or more. On the other hand, in order to suppress formation of island martensite and further improve toughness, the upper limit of the amount of Si contained is set to 0.50% or less. In order to secure the toughness, the upper limit of the amount of Si contained is set preferably to 0.35% or less, more preferably 0.30% or less.

Mn: 0.80% to 2.00%

Mn enhances hardenability, and causes formation of bainite to secure strength. Thus, the amount of Mn contained is set to 0.80% or more. In order to enhance the strength, the amount of Mn contained is set preferably to 1.00% or more, more preferably 1.30% or more. On the other hand, if the amount of Mn contained exceeds 2.00%, the toughness, resistance to cracking or other characteristics deteriorates. Thus, the upper limit of the amount of Mn contained is set to 2.00% or less. Preferably, the upper limit of the amount of Mn contained is set to 1.80% or less, more preferably 1.60% or less.

Cu: 0.04% to 0.40%

Cu is an element that improves hardenability, and contributes to strengthening the steel through precipitation strengthening. If the amount of Cu contained is 0.04% or more, a Cu phase precipitates on dislocations of ferrite when cooling during rolling is performed at temperatures in a range where ferrite is formed, whereby the strength increases. The amount of Cu contained is set preferably to 0.10% or more. On the other hand, if the amount of Cu contained exceeds 0.40%, the strength excessively increases, and low-temperature toughness deteriorates. Thus, the upper limit of the amount of Cu contained is set to 0.40% or less. Preferably, the upper limit of the amount of Cu contained is set to 0.30% or less, more preferably 0.25% or less.

Ni: 0.04% to 0.40%

Ni is a significantly effective element since it increases strength and toughness of the steel. In particular, in order to increase the toughness, the amount of Ni contained is set to 0.04% or more. Preferably, the amount of Ni contained is set to 0.10% or more. On the other hand, if the amount of Ni contained exceeds 0.40%, alloying costs increase. Thus, the upper limit of the amount of Ni contained is set to 0.40% or less. Preferably, the upper limit of the amount of Ni contained is set to 0.30% or less, more preferably 0.25% or less.

V: 0.01% to 0.10%

V forms carbonitrides, and contributes to making the structure finer and precipitation strengthening. Thus, the amount of V contained is set to 0.01% or more. Preferably, the amount of V contained is set to 0.05% or more. However, if the amount of V contained is excessive, precipitates coarsen, possibly leading to a deterioration in toughness. Thus, the upper limit of the amount of V contained is set to 0.10% or less. Preferably, the upper limit of the amount of V contained is set to 0.08% or less.

Al: 0.005% to 0.040%

Al is a deoxidizing element, and the amount of Al contained is set to 0.005% or more. Preferably, the amount of Al contained is set to 0.010% or more, more preferably 0.020% or more. On the other hand, in order to prevent formation of coarsened oxide, the upper limit of the amount of Al contained is set to 0.040% or less. Further, reducing the amount of Al is also effective in suppressing formation of island martensite. Thus, it is preferable to set the upper limit of the amount of Al contained to 0.030% or less.

Ti: 0.001% to 0.025%

Ti is an element that forms nitrides. Fine TiN contributes to reducing the size of crystal grains. Thus, the amount of Ti contained is set to 0.001% or more. Further, in order to fix N with Ti, and secure solute B to enhance hardenability, it is preferable to set the amount of Ti contained to 0.010% or more. On the other hand, if the amount of Ti contained exceeds 0.025%, coarsened TiN is formed, and the toughness deteriorates. Thus, the upper limit of the amount of Ti contained is set to 0.025% or less. Further, in order to suppress precipitation of TiC and suppress a reduction in toughness due to precipitation strengthening, it is preferable to set the upper limit of the amount of Ti contained to 0.020% or less.

B: 0.0003% to 0.0012%

B enhances hardenability with a small amount of B contained, and forms bainite effective in improving toughness. Thus, it is necessary to set the amount of B contained to 0.0003% or more. Preferably, the amount of B contained is set to 0.0004% or more, more preferably 0.0005% or more. On the other hand, if the amount of B contained exceeds 0.0012%, island martensite is formed, and the toughness significantly deteriorates. Thus, the amount of B contained is set to 0.0012% or less. The amount of B contained is set preferably to 0.0010% or less, more preferably 0.0007% or less.

Further, the composition of the H-beam steel according to this embodiment contains either or both of Mo and Nb.

Mo: 0.02% to 0.35%

Mo is an element that dissolves in the steel to enhance hardenability, and contributes to improving strength. In particular, a small amount of Mo and B that contributes to improving strength provides a significant synergy, and the lower limit of the amount of Mo contained is set to 0.02% or more. Preferably, the amount of Mo contained is set to 0.04% or more. However, if the amount of Mo contained exceeds 0.35%, Mo carbides ($Mo_2C$) precipitate, and the effect of improving hardenability with solute Mo saturates. Thus, the upper limit of the amount of Mo contained is set to 0.35% or less. The upper limit of the amount of Mo contained is set preferably to 0.20% or less, more preferably 0.10% or less.

Nb: 0.01% to 0.08%

Nb is an element that increases hardenability the same as Mo does. In particular, if Nb and B are contained in a combined manner, it is possible to obtain a significant effect of increasing the hardenability although the amounts are small. Thus, the lower limit of the amount of Nb is set to 0.01% or more. In order to improve the strength, it is preferable to set the amount of Nb contained to 0.02% or more. On the other hand, if the amount of Nb contained exceeds 0.08%, coarsened Nb carbonitrides precipitate, possibly deteriorating toughness. Thus, the upper limit of the amount of Nb contained is set to 0.08% or less. In order to enhance the toughness, it is preferable to set the amount of Nb contained to 0.07% or less. More preferably, the upper limit of the amount of Nb contained is set to 0.05% or less.

Mo+Nb: 0.43% or Less

The upper limit value of Mo+Nb is set to 0.43% or less, which is the total of the upper limit values of these elements. If the upper limit value of Mo+Nb exceeds 0.43%, the effect of improving the hardenability saturates. Thus, the upper limit value of Mo+Nb is set to 0.43%, preferably 0.30%, more preferably 0.15%.

N: 0.001% to 0.0090%

N forms fine TiN, and reduces the size of crystal grains. For this reason, the lower limit of the amount of N contained is set to 0.001% or more. Preferably, the lower limit of the amount of N contained is set to 0.0020% or more, more preferably 0.0030% or more. On the other hand, if the amount of N contained exceeds 0.0090%/c, coarsened TiN is generated, and the toughness deteriorates. Thus, the upper limit of the amount of N contained is set to 0.0090% or less. Further, an increase in the amount of N contained may lead to formation of island martensite, and deteriorate the toughness. Thus, it is preferable to set the amount of N contained to 0.0050% or less.

O: 0.0005% to 0.0035%

O is an impurity, and suppresses formation of oxide to secure toughness. Thus, the upper limit of the amount of O contained is set to 0.0035% or less. In order to improve HAZ toughness, it is preferable to set the amount of O contained to 0.0015 or less. If the amount of O contained is reduced to less than 0.0005%, manufacturing costs increase. Thus, it is preferable to set the amount of O contained to 0.0005% or more. In order to suppress coarsening of crystal grains in HAZ using the pinning effect resulting from oxide, it is preferable to set the amount of O contained to 0.0008% or more.

P: 0.03% or Less

S: 0.02% or Less

P and S are contained as inevitable impurities, and cause a deterioration in toughness and weld cracking occurring as a result of solidifying segregation. Thus, P and S should be reduced as much as possible. It is preferable to limit the amount of P contained to 0.03% or less, and more preferably, the upper limit of the amount of P contained is set to 0.02% or less. Further, it is preferable to limit the amount of S contained to 0.02% or less, and it is more preferable to limit the amount of S contained to 0.01% or less. The lower limit value of each of P and S is not specifically limited, and it is only necessary that they are over 0%. However, considering the cost for reducing the lower limit value of each of P and S, it may be possible to set the lower limit value of each of P and S to 0.0001% or more.

Ceq: 0.37 to 0.50

In order to enhance hardenability and form bainite, a carbon equivalent Ceq is set in a range of 0.37 to 0.50. If the Ceq is less than 0.37, bainite cannot be sufficiently formed, which results in a deterioration in strength. Preferably, the Ceq is set to 0.38 or more, and more preferably, the Ceq is set to 0.39 or more. On the other hand, if the Ceq exceeds 0.50, the strength excessively increases, and the toughness deteriorates. Thus, preferably, the Ceq is set to 0.46 or less, and more preferably, the Ceq is set to 0.44 or less.

The Ceq is an index of hardenability, and is obtained with the following Equation 1.

$$Ceq=C+Mn/6+(Mo+V)/5+(Ni+Cu)/15 \quad \text{Equation 1}$$

Further, in the case where Cr is contained as described later, the Ceq is obtained with the following Equation 2.

$$Ceq=C+Mn/6+(Cr+Mo+V)/5+(Ni+Cu)/15 \quad \text{Equation 2}$$

In the equations described above, C, Mn, Cr, Mo, V, Ni, and Cu represent the amount of the elements contained.

Cr: 0.20% or Less

Cr is an element that enhances hardenability, and it may be possible to make Cr contained as a selective element to improve strength. The amount of Cr contained is set preferably to 0.01% or more, and more preferably 0.05% or more. However, if the amount of Cr contained exceeds 0.20%, carbides are formed, possibly deteriorating toughness. Thus, the upper limit of the amount of Cr contained is set to 0.20% or less.

Since Cr is contained as the selective element, the lower limit value is not specifically limited, and thus is 0%.

Balance: Fe and Inevitable Impurities

In the H-beam steel containing the elements described above, the balance, which mainly includes Fe, may contain impurities inevitably entering during, for example, manufacturing processes, within a range that does not compromise the characteristics of the present invention.

Next, the microstructure of the ultra-thick H-beam steel according to this embodiment will be described. The ultra-thick H-beam steel has a surface layer where the rate of cooling is fast and a center that suffers the effect of segregation, and hence, the microstructure thereof is observed and the area fraction of bainite is measured at a portion of one quarter of flange thickness (in other words, at a depth of one quarter of flange thickness measured from the external surface of a flange), where the average structure across the thickness of the flange can be evaluated. The microstructure of the ultra-thick H-beam steel according to this embodiment mainly includes bainite having excellent strength and toughness, and the balance includes one of or two or more of ferrite, pearlite, and island martensite. The metal structure can be identified through observation with an optical microscope.

Bainite contributes to increasing strength and making the structure finer. However, if the area fraction of bainite is less than 60% at the position of one quarter of the flange thickness from the flange surface, the strength is not sufficient. Thus, the area fraction of bainite is set to 60% or more, preferably 70% or more, more preferably 80% or more, and most preferably 90% or more. In order to increase the toughness, it is preferable to increase the area fraction of bainite. Thus, the upper limit is not set, and it may be possible to set the area fraction of bainite to 100%. The area fraction of each microstructure is calculated as a ratio of the number of grains in each structure by using a photograph of structures taken with a magnification of ×200, arranging measurement points in a form of lattice with the length of a side of 50 μm, and distinguishing the structures at 300 measurement points.

The H-beam steel according to this embodiment has a flange with a thickness of more than 100 mm, or thickness in a range of 100 mm to 150 mm. This is because the H-beam steel used in a structure building is required to have a strengthened member having a thickness of 100 mm or more. On the other hand, if the thickness exceeds 150 mm, the sufficient rate of cooling cannot be obtained. Thus, the upper limit of the thickness is set to 150 mm. The thickness of a web of the H-beam steel is not specifically set. However, as in the case of the flange, the thickness of a web is preferably set in a range of 100 to 150 mm.

The ratio of flange to web in thickness is set preferably in a range of 0.5 to 2.0 on the assumption that the H-beam steel is manufactured through hot rolling. If the ratio of flange to web in thickness exceeds 2.0, the web may deform in a wavy shape. On the other hand, if the ratio of flange to web in thickness is less than 0.5, the flange may deform in a wavy shape.

For the mechanical characteristics, the target values are set as follows: yield strength or 0.2% proof strength at normal temperatures is set to 450 MPa or more; and, tensile strength is set to 550 MPa or more. Further, the Charpy absorbing energy at 21° C. is set to 54 J or more. The excessively high strength possibly causes a deterioration in toughness. Thus, it is preferable to set yield strength or 0.2% proof strength at normal temperatures to 500 MPa or less, and set tensile strength to 680 MPa or less.

In particular, the H-beam steel requires rolling processes at high temperatures, and hence it is more difficult to secure strength and toughness as compared with manufacturing steel sheets. In particular, in the case where the ultra-thick H-beam steel is manufactured from slab or materials having a beam blank shape, it is difficult to secure the amount of working at the fillet portion (portion where the flange and the web are jointed) as well as the flange, and it is difficult to reduce the size of grains.

Next, a preferred method of manufacturing the H-beam steel according to this embodiment will be described.

In steel-making processes, chemical components in the molten steel are adjusted as described above, and then, casting is performed to obtain blooms. For casting, it is preferable to employ continuous casting from the viewpoint of productivity. Further, it is preferable to set the thickness of the bloom to 200 mm or more from the viewpoint of productivity. By considering a reduction in segregation, and uniformity in heating temperatures during hot rolling, it is preferable to set the thickness of the bloom to 350 mm or less.

Next, the bloom is heated, and hot rolling is performed. The heating temperatures to the bloom are not specifically set, but are set preferably in the range of 1100 to 1350° C. If the heating temperature is lower than 1100° C., the resistance to deformation increases. In order to sufficiently dissolve elements such as Nb that form carbides and nitrides, it is preferable to set the lower limit of the reheating temperatures to 1150° C. or higher. In particular, in the case where the thickness is thin, the cumulative rolling reduction increases, and hence, it is preferable to heat to 1200° C. or higher. On the other hand, in the case where the heating temperatures are set to high temperatures higher than 1350° C., scales on the surface of the bloom, which is a raw material, liquefy, and the inside of the heating furnace may be damaged. In order to suppress coarsening of the structures, it is preferable to set the upper limit of the heating temperatures to 1300° C. or lower.

During finishing rolling in the hot rolling, it is preferable to perform controlled rolling. Controlled rolling is a manufacturing method in which rolling temperatures and rolling reduction are controlled. In finishing rolling, it is preferable that water-cooling rolling between passes is performed for one or more passes. The water-cooling rolling between passes is a manufacturing method in which water cooling is performed, for example, through water immersion cooling or spray cooling, and rolling is performed during a reheating process. Further, it may be possible to employ a so-called two-heat rolling, which is a manufacturing process in which the first rolling is performed, then temperatures are decreased to 500° C. or lower, temperatures are increased again to 1100 to 1350° C., and then, the second rolling is performed. With the two-heat rolling, the amount of plastic deformation is small during hot rolling, and a reduction in temperatures is small during rolling processes. Thus, it is possible to set the heating temperatures to be lower.

It is desirable to perform finishing rolling in hot rolling in a manner such that, after the bloom is heated, rolling is performed for one or more passes at temperatures of the flange surface of 930° C. or lower. This is because, through hot rolling, recrystallization by working is facilitated, and austenite is made fine-grained, thereby improving toughness and strength. Note that rough rolling may be performed before finishing rolling depending on the thickness of the bloom and the thickness of the product.

During finishing rolling, it is preferable that the water-cooling rolling between passes is performed for one or more passes. The water-cooling rolling between passes is a method of rolling in which surface temperatures of the flange are cooled to 700° C. or lower, and then, rolling is performed during a reheating process. The water-cooling rolling between passes is a method of rolling in which, by performing water cooling between rolling passes, temperatures are made different between the surface layer portion of the flange and the inside of the flange. During water-cooling rolling between passes, it is possible to introduce work strain into the inside of steel in the thickness direction even if rolling reduction is small. Further, by decreasing the rolling temperatures within a short period of time through water cooling, productivity can be improved.

rate of cooling faster than 15° C./s, excessively large cooling equipment is necessary, which requires further costs and is not economical.

EXAMPLES

Steels containing components shown in Table 1 were smelted, and continuous casting was performed to manufacture steel pieces each having a thickness in a range of 240 to 300 mm. Smelting the steels was performed with a converter. Primary deoxidation was performed. Alloys were added to adjust the components. Further, vacuum degassing processes were performed depending on applications. The steel pieces thus obtained were heated, and hot rolling was performed, thereby manufacturing H-beam steels. The components shown in Table 1 were obtained through chemical analysis on samples taken from the H-beam steels after manufacturing.

TABLE 1

| Steel | Components (mass %) | | | | | | | | | | | | | | | | | |
|---|---|---|---|---|---|---|---|---|---|---|---|---|---|---|---|---|---|---|
| No. | C | Si | Mn | P | S | Cu | Ni | V | Al | Ti | B | N | O | Mo | Nb | Cr | Ceq | Note |
| A | 0.110 | 0.28 | 1.54 | 0.020 | 0.007 | 0.20 | 0.10 | 0.06 | 0.027 | 0.001 | 0.0004 | 0.0034 | 0.0021 | 0.05 | | | 0.41 | Steel |
| B | 0.120 | 0.28 | 1.56 | 0.020 | 0.007 | 0.20 | 0.10 | 0.05 | 0.027 | 0.001 | 0.0004 | 0.0041 | 0.0021 | | 0.03 | | 0.41 | according |
| C | 0.140 | 0.28 | 1.54 | 0.020 | 0.007 | 0.20 | 0.10 | 0.06 | 0.027 | 0.001 | 0.0004 | 0.0034 | 0.0025 | 0.04 | | | 0.44 | to the |
| D | 0.130 | 0.28 | 0.90 | 0.020 | 0.007 | 0.30 | 0.30 | 0.08 | 0.027 | 0.001 | 0.0005 | 0.0034 | 0.0020 | 0.05 | | 0.10 | 0.37 | present |
| E | 0.110 | 0.28 | 1.54 | 0.020 | 0.007 | 0.30 | 0.10 | 0.10 | 0.027 | 0.001 | 0.0003 | 0.0030 | 0.0020 | 0.04 | 0.01 | | 0.42 | invention |
| F | 0.110 | 0.28 | 1.50 | 0.020 | 0.007 | 0.20 | 0.10 | 0.06 | 0.036 | 0.001 | 0.0004 | 0.0035 | 0.0019 | 0.05 | | | 0.40 | |
| G | 0.120 | 0.34 | 1.54 | 0.021 | 0.007 | 0.20 | 0.10 | 0.06 | 0.005 | 0.001 | 0.0005 | 0.0034 | 0.0030 | 0.05 | | | 0.42 | |
| H | 0.110 | 0.27 | 1.50 | 0.020 | 0.007 | 0.20 | 0.10 | 0.06 | 0.025 | 0.025 | 0.0004 | 0.0035 | 0.0019 | 0.05 | | | 0.40 | |
| I | 0.090 | 0.21 | 1.54 | 0.020 | 0.007 | 0.20 | 0.10 | 0.06 | 0.027 | 0.001 | 0.0005 | 0.0080 | 0.0019 | 0.05 | | | 0.39 | |
| J | 0.090 | 0.21 | 1.54 | 0.020 | 0.007 | 0.20 | 0.31 | 0.06 | 0.027 | 0.001 | 0.0012 | 0.0080 | 0.0034 | 0.05 | | | 0.40 | |
| K | 0.100 | 0.28 | 1.50 | 0.019 | 0.008 | 0.10 | 0.10 | 0.06 | 0.027 | 0.001 | 0.0004 | 0.0034 | 0.0021 | 0.08 | | | 0.39 | |
| L1 | 0.090 | 0.28 | 1.54 | 0.020 | 0.007 | 0.20 | 0.10 | 0.06 | 0.027 | 0.001 | 0.0004 | 0.0019 | 0.0020 | | 0.07 | | 0.38 | |
| L2 | 0.090 | 0.28 | 1.54 | 0.020 | 0.007 | 0.20 | 0.10 | 0.06 | 0.027 | 0.001 | 0.0004 | 0.0019 | 0.0020 | 0.34 | 0.07 | | 0.44 | |
| M | 0.160 | 0.28 | 1.54 | 0.020 | 0.007 | 0.20 | 0.10 | 0.06 | 0.027 | 0.001 | 0.0004 | 0.0034 | 0.0020 | 0.05 | | | 0.46 | Comparative |
| N | 0.080 | 0.28 | 1.55 | 0.020 | 0.007 | 0.20 | 0.10 | 0.06 | 0.027 | 0.001 | 0.0004 | 0.0038 | 0.0022 | 0.05 | | | 0.38 | steel |
| O | 0.110 | 0.04 | 1.54 | 0.020 | 0.007 | 0.20 | 0.10 | 0.06 | 0.027 | 0.001 | 0.0004 | 0.0034 | 0.0034 | 0.05 | | | 0.41 | |
| P | 0.110 | 0.52 | 1.54 | 0.020 | 0.007 | 0.20 | 0.10 | 0.06 | 0.027 | 0.001 | 0.0003 | 0.0036 | 0.0018 | 0.05 | | | 0.41 | |
| Q | 0.090 | 0.28 | 2.11 | 0.020 | 0.007 | 0.20 | 0.10 | 0.06 | 0.027 | 0.001 | 0.0003 | 0.0034 | 0.0020 | 0.05 | | | 0.48 | |
| R | 0.147 | 0.28 | 1.76 | 0.021 | 0.007 | 0.34 | 0.27 | 0.08 | 0.027 | 0.001 | 0.0004 | 0.0034 | 0.0021 | 0.10 | 0.02 | | 0.52 | |
| S | 0.100 | 0.28 | 1.54 | 0.020 | 0.007 | 0.20 | 0.10 | 0.06 | 0.027 | 0.001 | 0.0004 | 0.0034 | 0.0025 | 0.05 | | 0.22 | 0.44 | |
| T | 0.110 | 0.27 | 1.53 | 0.020 | 0.007 | 0.20 | 0.10 | 0.13 | 0.027 | 0.001 | 0.0004 | 0.0034 | 0.0024 | 0.05 | | | 0.42 | |
| U | 0.110 | 0.28 | 1.54 | 0.020 | 0.008 | 0.20 | 0.10 | 0.06 | 0.050 | 0.001 | 0.0004 | 0.0033 | 0.0019 | 0.05 | | | 0.41 | |
| V | 0.110 | 0.26 | 1.51 | 0.020 | 0.007 | 0.20 | 0.10 | 0.06 | 0.027 | 0.031 | 0.0004 | 0.0034 | 0.0019 | 0.05 | | | 0.40 | |
| W | 0.120 | 0.28 | 1.54 | 0.020 | 0.007 | 0.20 | 0.10 | 0.06 | 0.027 | 0.001 | 0.0004 | 0.0101 | 0.0021 | 0.05 | | | 0.42 | |
| X | 0.090 | 0.28 | 1.54 | 0.020 | 0.007 | 0.20 | 0.10 | 0.06 | 0.027 | 0.001 | 0.0004 | 0.0034 | 0.0040 | 0.05 | | | 0.39 | |
| Y | 0.100 | 0.27 | 1.53 | 0.021 | 0.007 | 0.19 | 0.10 | 0.06 | 0.027 | 0.001 | 0.0016 | 0.0034 | 0.0021 | 0.05 | | | 0.40 | |
| Z | 0.090 | 0.27 | 1.53 | 0.020 | 0.007 | 0.20 | 0.10 | 0.06 | 0.027 | 0.001 | 0.0004 | 0.0034 | 0.0022 | 0.36 | | | 0.45 | |
| AA | 0.100 | 0.28 | 1.53 | 0.020 | 0.007 | 0.20 | 0.10 | 0.06 | 0.027 | 0.001 | 0.0004 | 0.0034 | 0.0021 | | 0.10 | | 0.39 | |
| AB | 0.110 | 0.28 | 1.53 | 0.020 | 0.007 | 0.20 | 0.10 | 0.06 | 0.027 | 0.001 | 0.0004 | 0.0034 | 0.0021 | 0.01 | | | 0.40 | |
| AC | 0.100 | 0.29 | 1.55 | 0.020 | 0.007 | 0.20 | 0.10 | 0.06 | 0.027 | 0.001 | 0.0004 | 0.0033 | 0.0020 | | | | 0.39 | |
| AD | 0.110 | 0.28 | 1.53 | 0.020 | 0.007 | 0.20 | 0.10 | 0.06 | 0.027 | 0.001 | 0.0002 | 0.0034 | 0.0019 | 0.05 | | | 0.41 | |
| AE | 0.096 | 0.47 | 0.89 | 0.020 | 0.007 | 0.36 | 0.32 | 0.09 | 0.024 | 0.012 | 0.0005 | 0.0041 | 0.0023 | 0.14 | 0.04 | 0.12 | 0.36 | |

Blank cells indicate that elements are intentionally not added.
Underlines indicate that values fall outside the range of the present invention.

Next, the rate of cooling for manufacturing the H-beam steel according to this embodiment will be described. In order to obtain high strength, it is effective to, after finishing rolling, apply a predetermined rate of cooling at the position of one quarter of the flange thickness from the flange surface through water cooling (accelerated cooling) applied to the flange surface. It is preferable to perform the accelerated cooling in a manner such that the rate of cooling at the position of one quarter of flange thickness from the flange surface is set in a range of 2.2 to 15° C./s in a temperature range of 800° C. to 500° C. If the rate of cooling is slower than 2.2° C./s, there is a possibility that the desired hardened structure cannot be obtained. Further, in order to obtain the FIG. 1 shows processes of manufacturing an H-beam steel. Hot rolling was performed with a series of universal rolling units. In the case where water-cooling rolling between passes is employed for hot rolling, water cooling was performed between rolling passes using water cooling devices 2*a* provided on front and rear surfaces of an intermediate universal rolling mill (intermediate rolling mill) 1, spray cooling was performed to surfaces on the external side of the flange, and reverse rolling was performed. Accelerated cooling after controlled rolling was performed in a manner such that, after finishing rolling is completed with a finishing universal rolling mill (finish rolling mill) 3, the surfaces on the external side of the flange were water cooled with a cooling device (water cooling device) 2*b* provided on the rear face. Table 2 shows manufacturing conditions.

TABLE 2

| Manufacturing No. | Steel No. | Heating temperature (° C.) | Finish rolling temperature (° C.) | Cooling rate (° C./s) | Flange thickness (mm) | Area fraction of bainite (%) | Balance | YS (MPa) | TS (MPa) | vE21 (J) |
|---|---|---|---|---|---|---|---|---|---|---|
| Example 1 | A | 1300 | 900 | 3 | 125 | 90 | F, P | 460 | 626 | 62 |
| Example 2 | A | 1300 | 900 | 5 | 100 | 92 | F, P | 471 | 632 | 90 |
| Example 3 | A | 1300 | 900 | 2.3 | 150 | 65 | F, P | 452 | 580 | 57 |
| Example 4 | B | 1300 | 900 | 3 | 125 | 91 | F, MA | 478 | 652 | 60 |
| Example 5 | C | 1300 | 900 | 3 | 125 | 96 | F, MA | 491 | 670 | 57 |
| Example 6 | D | 1300 | 900 | 3 | 125 | 64 | F, P | 452 | 557 | 70 |
| Example 7 | E | 1300 | 900 | 3 | 125 | 93 | F | 480 | 651 | 58 |
| Example 8 | F | 1300 | 900 | 3 | 125 | 89 | F, MA | 453 | 616 | 62 |
| Example 9 | G | 1300 | 900 | 3 | 125 | 90 | F | 459 | 621 | 61 |
| Example 10 | H | 1300 | 900 | 3 | 125 | 86 | F | 453 | 616 | 63 |
| Example 11 | I | 1300 | 900 | 3 | 125 | 86 | F, P | 460 | 600 | 59 |
| Example 12 | J | 1300 | 900 | 3 | 125 | 92 | MA | 461 | 627 | 58 |
| Example 13 | K | 1300 | 900 | 3 | 125 | 93 | P | 480 | 653 | 63 |
| Example 14A | L1 | 1300 | 900 | 3 | 125 | 93 | P, MA | 462 | 634 | 59 |
| Example 14B | L2 | 1300 | 900 | 3 | 125 | 95 | MA | 472 | 640 | 57 |
| Comperative Example 15 | M | 1300 | 900 | 3 | 125 | 95 | MA | 520 | 700 | 50 |
| Comperative Example 16 | N | 1300 | 900 | 3 | 125 | 57 | F | 421 | 545 | 66 |
| Comperative Example 17 | O | 1300 | 900 | 3 | 125 | 55 | F, P | 442 | 546 | 62 |
| Comperative Example 18 | P | 1300 | 900 | 3 | 125 | 91 | P, MA | 461 | 627 | 47 |
| Comperative Example 19 | Q | 1300 | 900 | 3 | 125 | 98 | MA | 534 | 730 | 49 |
| Comperative Example 20 | R | 1300 | 900 | 3 | 125 | 96 | MA | 473 | 636 | 37 |
| Comperative Example 21 | S | 1300 | 900 | 3 | 125 | 94 | MA | 480 | 652 | 51 |
| Comperative Example 22 | T | 1300 | 900 | 3 | 125 | 93 | MA | 476 | 647 | 41 |
| Comperative Example 23 | U | 1300 | 900 | 3 | 125 | 90 | F, MA | 461 | 627 | 50 |
| Comperative Example 24 | V | 1300 | 900 | 3 | 125 | 91 | F | 455 | 619 | 49 |
| Comperative Example 25 | W | 1300 | 900 | 3 | 125 | 80 | F, P | 471 | 627 | 37 |
| Comperative Example 26 | X | 1300 | 900 | 3 | 125 | 54 | F, P | 440 | 540 | 38 |
| Comperative Example 27 | Y | 1300 | 900 | 3 | 125 | 93 | MA | 465 | 636 | 31 |
| Comperative Example 28 | Z | 1300 | 900 | 3 | 125 | 95 | MA | 471 | 630 | 39 |
| Comperative Example 29 | AA | 1300 | 900 | 3 | 125 | 92 | MA | 472 | 630 | 38 |
| Comperative Example 30 | AB | 1300 | 900 | 3 | 125 | 58 | F, P | 448 | 544 | 63 |
| Comperative Example 31 | AC | 1300 | 900 | 3 | 125 | 57 | F, P | 448 | 548 | 64 |
| Comperative Example 32 | AD | 1300 | 900 | 3 | 125 | 55 | F, P | 447 | 546 | 61 |
| Comperative Example 33 | AE | 1300 | 900 | 3 | 125 | 56 | F, P | 443 | 545 | 65 |

P: perlite,
MA: island martensite,
F: ferrite

Figure 2:
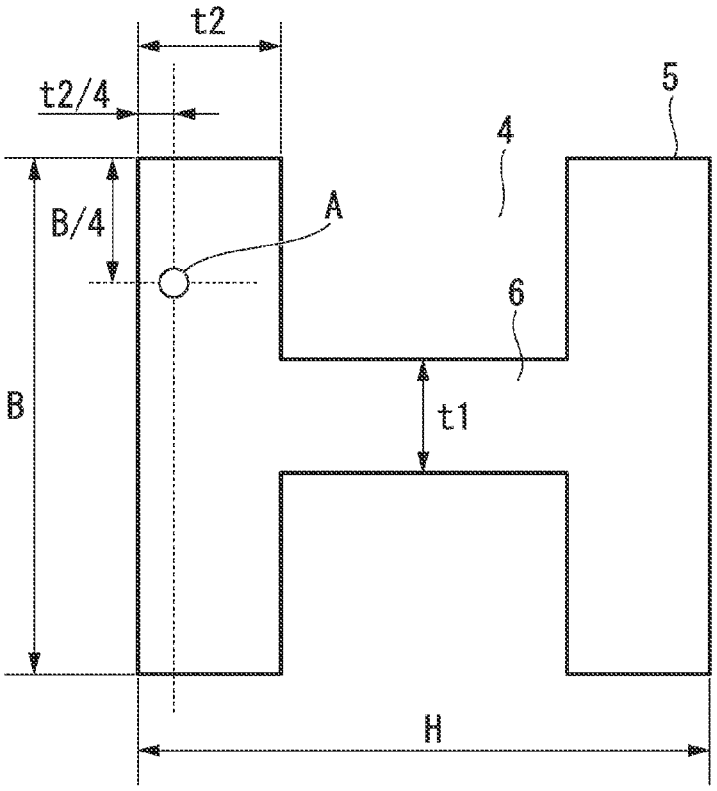
FIG. 2 is a diagram for explaining a test-piece taking position A.

FIG. 2 is a diagram for explaining a test-piece taking position A. As illustrated in FIG. 2, the test-piece taking position A is located at a depth (t2/4) of one quarter of a thickness t2 from the external surface of a flange 5 of a H-beam steel 4 and at a position ¼B (B/4) of the entire width length B of the flange. Test pieces were taken from this test-piece taking position A, and mechanical properties thereof were measured. The reference character t1 represents the thickness of a web, and the reference character H represents the height. Note that the properties were measured at this position because the properties at the test-piece taking position A illustrated in FIG. 2 are judged to represent average mechanical properties of the H-beam steel. Tensile tests were performed in accordance with JIS Z 2241 (2011). If a sample showed yielding behavior, the yield point was obtained as YS. If the samples did not show yielding behavior, the 0.2% proof strength was obtained as YS. Charpy impact test was performed at 21° C. in accordance with JIS Z 2242 (2011).

Further, samples were taken from the test-piece taking position A used for measuring the mechanical properties, and metal structures were observed with an optical microscope to measure the area fraction of bainite. Further, types of the remaining structures were identified.

The results are shown in Table 2. In Table 2, YS represents the yield point or 0.2% proof strength at normal temperatures. The target values of the mechanical properties are as follows: yield strength or 0.2% proof strength (YS) is 450 MPa or more at normal temperatures; and tensile strength (TS) is 550 MPa or more. Charpy absorbing energy ($vE_{21}$) at 21° C. is 54 J or more.

As shown in Table 2, Examples 1 to 14B according to the present invention each have YS and TS satisfying 450 MPa and 550 MPa or more, which are the lower limit values of the target. Further, the Charpy absorbing energy at 21° C. is 54 J or more, and sufficiently achieve the target.

On the other hand, as shown in Table 2, Comparative Example 15 contains a large amount of C, Comparative Example 18 contains a large amount of Si, and Comparative Example 21 contains a large amount of Cr, each of which is an example that has deteriorated toughness. Comparative Example 16 contains a reduced amount of C, and Comparative Example 17 contains a reduced amount of Si, each of which results in a reduction in the area fraction of bainite, and a reduction in the strength. Further, Comparative Example 19 is an example that contains an excessive amount of Mn, and Comparative Example 20 is an example that has an excessive Ceq, each of which has increased strength and reduced toughness. Comparative Example 22 contains an excessive amount of V, which results in a decrease in toughness due to coarsened precipitates.

Comparative Example 23 is an example that contains an excessive amount of Al, Comparative Example 24 is an example that contains an excessive amount of Ti, Comparative Example 25 is an example that contains an excessive amount of N, and Comparative Example 26 is an example that contains an excessive amount of O, each of which results in a deterioration in toughness.

Comparative Example 27 is an example that contains a large amount of B, which results in a deterioration in toughness due to island martensite.

Comparative Example 28 is an example that contains a large amount of Mo, and Comparative Example 29 is an example that contains a large amount of Nb, each of which results in formation of coarsened precipitates to deteriorate toughness.

Comparative Example 33 is an example that has excessively small Ceq. Comparative Example 30 is an example that contains a reduced amount of Mo and does not contain Nb. Comparative Example 31 is an example that does not contain Mo or Nb. Comparative Example 32 is an example that contains a reduced amount of B. These examples have reduced area fraction of bainite, and exhibit reduced strength.

INDUSTRIAL APPLICABILITY

According to the present invention, it is possible to obtain a high-strength ultra-thick H-beam steel having a flange thickness in a range of 100 to 150 mm, yield strength or 0.2% proof strength of 450 MPa or more, and tensile strength of 550 MPa or more. The high-strength ultra-thick H-beam steel according to the present invention can be manufactured without adding the large amount of alloys or reducing carbon to the ultra low carbon level, which causes significant steel-making loads. This makes it possible to reduce manufacturing costs and shorten manufacturing time, thereby achieving a significant reduction in the total costs. Thus, reliability of large buildings can be enhanced without sacrificing cost efficiency, and hence, the present invention makes an extremely significant contribution to industries.

BRIEF DESCRIPTION OF THE REFERENCE SYMBOLS

1 Intermediate rolling mill
2*a* Water cooling device on front and rear surfaces of intermediate rolling mill
2*b* Cooling device on rear surface of finish rolling mill
3 Finish rolling mill
4 H-beam steel
5 Flange
6 Web
B Entire length of flange width
H Height
t1 Thickness of web
t2 Thickness of flange

The invention claimed is:

1. An H-beam steel with a composition comprising, in mass:

C: 0.110 to 0.15%;
Si: 0.20 to 0.50%;
Mn: 0.80 to 2.00%;
Cu: 0.04 to 0.25%;
Ni: 0.04 to 0.40%;
V: 0.01 to 0.10%;
Al: 0.005 to 0.040%;
Ti: 0.001 to 0.025%;
B: 0.0003 to 0.0012%;
N: 0.001 to 0.0090%;
O: 0.005 to 0.0035%,
at least one of Mo: 0.02 to 0.35% and Nb: 0.01 to 0.08%;
P: limited to not more than 0.03%; and
S: limited to not more than 0.02%,
with a balance including Fe and inevitable impurities; wherein
Ceq obtained with Equation 1 described below falls in a range of 0.37 to 0.50,
a thickness of a flange falls in a range of 100 to 150 mm, and
an area fraction of bainite at a depth of one quarter of the thickness of the flange from the external surface of the flange is not less than 60%, $$Ceq=C+Mn/6+(Mo+V)/5+(Ni+Cu)/15 \quad \text{Equation 1.}$$

2. The H-beam steel according to claim 1, wherein the composition further comprises, in mass, Cr: not more than 0.20%, and
Ceq obtained with Equation 2 described below falls in a range of 0.37 to 0.50, $$Ceq=C+Mn/6+(Cr+Mo+V)/5+(Ni+Cu)/15 \quad \text{Equation 2.}$$

3. The H-beam steel according to claim 1 or 2, wherein yield strength or 0.2% proof strength is not less than 450 MPa, and
tensile strength is not less than 550 MPa.

4. The H-beam steel according to claim 1 or 2, wherein the amount of Mo is limited to not more than 0.20% in mass.

5. The H-beam steel according to claim 1 or 2, wherein the amount of Mo is limited to not more than 0.10% in mass.

6. The H-beam steel according to claim 1 or 2, wherein the area fraction of bainite at the depth of one quarter of the thickness of the flange from the external surface of the flange is not less than 90%.

7. The H-beam steel according to claim 1 or 2, wherein the amount of Cu is 0.04% to 0.20% in mass.

8. The H-beam steel according to claim 1 or 2, wherein the amount of Ni is 0.04% to 0.25% in mass.

9. The H-beam steel according to claim 1 or 2, wherein the amount of Mo is 0% to limited to not more than 0.08% in mass.

* * * * *